US006514115B2

(12) United States Patent
Harich

(10) Patent No.: US 6,514,115 B2
(45) Date of Patent: Feb. 4, 2003

(54) LINE SYSTEM FOR STEERING A KITE

(75) Inventor: Armin Harich, Dreieich (DE)

(73) Assignee: Skywalk GmbH & Co. KG (DE)

( * ) Notice: Subject to any disclaimer, the term of this patent is extended or adjusted under 35 U.S.C. 154(b) by 0 days.

(21) Appl. No.: 10/058,241

(22) Filed: Jan. 25, 2002

(65) Prior Publication Data

US 2002/0187717 A1 Dec. 12, 2002

(51) Int. Cl.[7] ..... A63H 27/08
(52) U.S. Cl. ..... 446/34; 244/155 A; 114/39.12
(58) Field of Search ..... 446/34, 61, 176; 244/155 A, 153 R; 114/39.12, 39.16

(56) References Cited

U.S. PATENT DOCUMENTS 4,418,631 A * 12/1983 Frohbach ..... 114/39.12
5,417,390 A * 5/1995 Southwick ..... 244/153 R
6,199,499 B1 * 3/2001 Horais ..... 114/162
6,273,369 B1 * 8/2001 Nishimura et al. ..... 244/153 R

* cited by examiner

*Primary Examiner*—Jacob K. Ackun
(74) *Attorney, Agent, or Firm*—Oppenheimer Wolff & Donnelly LLP; Claude A. S. Hamrick

(57) ABSTRACT

A line system for steering a kite is described, which achieves the five elementary functions for steering a kite (steering to the right, steering to the left, safety function, rearward flight/start-up and depowering) with only three lines.

6 Claims, 4 Drawing Sheets

LINE SYSTEM FOR STEERING A KITE

RELATED APPLICATION

Applicant claims priority under 35 USC 119 to German Patent Application No. DE 201 07 925.9 filed May 10, 2001.

BACKGROUND OF THE INVENTION

The sport of kitesurfing has recently become established. Kitesurfing is a method of locomotion similar to surfing or waterskiing. A sportsperson—referred to as a kiteboarder or kitesurfer—stands on a type of small surfboard on the water and is driven by a kite. The kite is held and steered by the kitesurfer by way of lines and stands at a height of approximately 10 to 50 meters above the water in the wind. At this height, the kite comes up against favorable winds. In this way, it is possible to achieve rapid movement similar to waterskiing.

The kite is a steering canopy similar to a paraglider or hang-glider, i.e. a flexible flying wing. Depending on the direction in which the kite is steered, it is possible to change the direction and strength of the pulling force of the kite. The force or pulling force of the kite always acts in the direction of the lines here. The kite is of aerofoil form, as a result of which it is possible to achieve an effective force in a direction perpendicular to the wind direction. It is thus also possible to tack against the wind, as with windsurfing equipment or a sailing boat.

It is generally the case that such kites are also suitable for driving sailing boats, ships or land-bound vehicles.

Two types of kites are basically known for kitesurfing, these being inflatable kites and soft kites.

An inflatable kite contains closed volume elements, chambers, which are inflated like a lilo, are closed by a plastic valve and keep the inflatable kite in the aerofoil form.

A soft kite does not contain any completely closed chambers. It comprises an upper sail and a lower sail which are adjacent to one another at a profile nose and a trailing profile edge. A soft kite also has at least one air-inlet opening in the lower sail with a respectively associated valve through which incoming air passes into the interior of the soft kite. Similarly to a paraglider, the soft kite automatically fills with air in the wind in order to achieve an aerofoil form.

Reference is made hereinbelow to FIG. 1, which shows a control bar 10 and the conventional lines for steering a kite.

The control bar 10 has a rubber coating so that it can be gripped in the hand without slipping even in wet and cold conditions. The control bar 10 has a harness line loop 20, with the aid of which the control bar 10 can be fitted into a hook on a kitesurfer's harness, a corset-like vest like that used for windsurfing.

Two steering lines 12, 14 for the kite are fastened on the right and left on the outside of the control bar 10. The steering lines each act on the right-hand and left-hand wing ends of the kite. If one pulls, for example, on the right-hand steering line, then the kite tends to the right and flies through a right-hand curve.

Also provided is a depowering line 16 which acts on the front region of the kite and, upon actuation, pulls this down. The kite thus changes its angle of attack in the wind. It is positioned more flatly in the wind, as a result of which the force to which the kite is subjected in the wind is weaker. This results in the name "depowering line". The depowering line 16 is guided in the center of the control bar 10 and terminates in an annular loop, the so-called trim loop 18. The latter may be fitted into the hook of the harness. If the kitesurfer guides the control bar 10 away from his/her body because the pulling forces are becoming too great, the steering lines 12, 14 are released, but the depowering line 16 fastened on the harness is not. This results in a reduction in the lift to which the kite is subjected.

A common alternative to the depowering line is a brake line which pulls on the trailing profile edge and inflects the latter downward. This changes the profile shape and the flow around the kite can break away. In the case of pronounced pulling, the kite folds over and flies rearward in a pressureless state until it lands. Only a small amount of pulling is necessary, by way of a brake line, in order to start the kite from the water in the rearward direction.

Also usually provided is a safety leash which connects a steering line to the kitesurfer and is fastened, for example, on the kitesurfer's arm or harness. The safety leash thus connects the kitesurfer and sail and/or control bar. The safety leash is normally loose and powerless. If, however, the kitesurfer loses the control bar and depowering line, he/she nevertheless remains connected to the control bar and kite via the safety leash. The only effective force is then a force to which that steering line on which the safety leash is fastened is subjected. The kite should then land as far as possible in a pressureless and controlled state. On account of the connection via the safety leash, it is possible to retrieve the control bar and kite.

Each kite should cover five elementary functions. These are: steering to the right, steering to the left, safety function, rearward flight/start-up and depowering. The known line systems, with four lines, only achieve four functions. The depowering line and brake line are never present simultaneously, and the operations of depowering and rearward start-up are thus never achieved at the same time.

A known line system for steering an inflatable kite 22 is illustrated schematically in FIG. 2. It has a left-hand steering line 12 and a right-hand steering line 14, which are fastened on the right and left on the outside of the control bar 10 held by the kitesurfer. They act on the trailing profile edge 15 approximately 2 m away from the wing ends. Also provided is a depowering line 24 which is guided centrally through the control bar 10 and can be fastened on the kitesurfer's harness with the aid of a so-called trim loop 18. A short distance above the control bar 10, the depowering line 24 divides into a left-hand depowering line 26 and a right-hand depowering line 28, which act on the profile nose 11 at the wing ends.

On the leading profile edge, in each case one deflecting device 30 is fastened directly at the left-hand and right-hand wing ends. Located between the left-hand depowering line 26 and the left-hand steering line 12 is a connecting line 32, which is guided over the deflecting device 30 in the manner of a block and tackle. The connecting line 32 acts on the left-hand depowering line 26 approximately 2.5 m beneath the point at which the depowering line is fastened on the kite. The other end of the connecting line 32 acts on the left-hand steering line 12 approximately 90 cm beneath the deflecting device 30. A corresponding connecting line 32 is located between the right-hand depowering line 28 and the right-hand steering line 14.

If the left-hand steering line 12 is pulled, then, via the connecting line 32, the left-hand wing end 13 is pulled downward on the trailing profile edge 15, albeit, on account of the deflection in the deflecting device 30, only by half the extent of the movement of the left-hand steering line 12. This increases the air resistance of the kite at the left-hand wing end. On the right-hand side, there is a reduction in the air resistance as a result of the release of the roller 30. The kite executes a left-hand curve. The steering lines, which pass directly to the trailing edge 15 of the kite, hang freely and are not utilized for steering purposes.

A corresponding result is achieved if the right-hand steering line 14 is pulled.

If the two steering lines 12, 14 are pulled by a few meters at the same time, then the steering lines, which are guided as far as the trailing profile edge 15, become taut. This makes it possible to increase the angle of attack of the kite and to fly or to start up the kite, e.g. from the water, in the rearward direction. As a result of the strength of the inflatable kite, the profile is thus not curved.

If the depowering line 24 is pulled, then, on the one hand, the profile nose 11 is pulled downward at the wing end 13. On the other hand, as a result of the connecting lines 32, the trailing profile edge 15 is also pulled downward at the wing ends 13, albeit, on account of the deflection in the deflecting device 30, only by half the extent of the movement of the depowering lines. The kite 11 thus obtains a shallower angle of attack in the wind. This reduces the forces acting on the kite. The kite is thus depowered.

In the case of this known line system, the lines control the angle of attack of the kite in the wind. Curvature of the profile is not envisaged. A safety function as a result of the trailing edge folding over is thus not provided. Depowering via the curvature of the kite is not possible either.

SUMMARY OF THE INVENTION

The object of the invention is to specify an improved line system for a kitesurfer to steer a kite.

This object is achieved by the invention according to the independent claim. Advantageous embodiments of the invention are characterized in the subclaims.

The line system according to the invention covers the five elementary functions with only three lines, as will be explained at a later stage in the text.

It is particularly advantageous to use such a line system for a soft kite since the kite is more deformable. It is also possible, however, to use the line system for an inflatable kite.

The invention is explained in more detail hereinbelow with reference to exemplary embodiments which are illustrated schematically in the figures. The same designations in the individual figures designate the same elements.

IN THE DRAWING

DETAILED DESCRIPTION OF THE PREFERRED EMBODIMENTS

Figure 1:
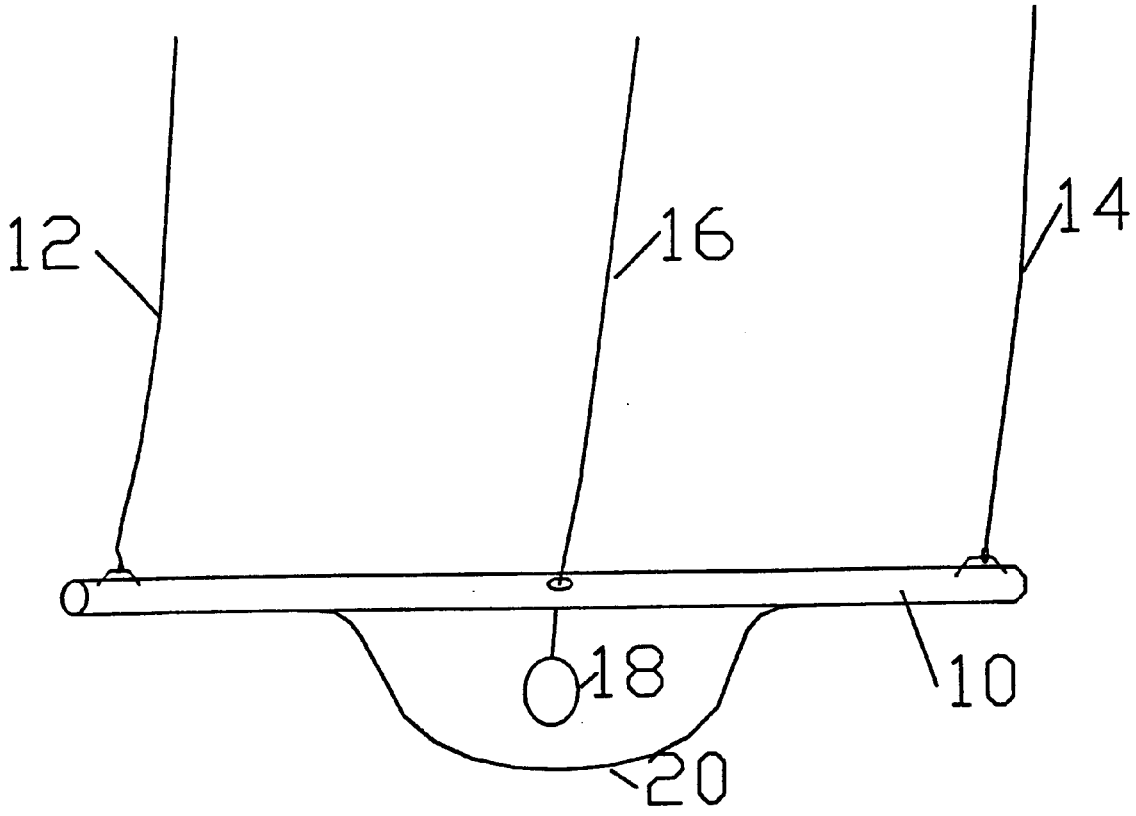
Fig.1 (PRIOR ART)
FIG. 1 shows a schematic illustration of the control bar for steering a kite.
Figure 2:
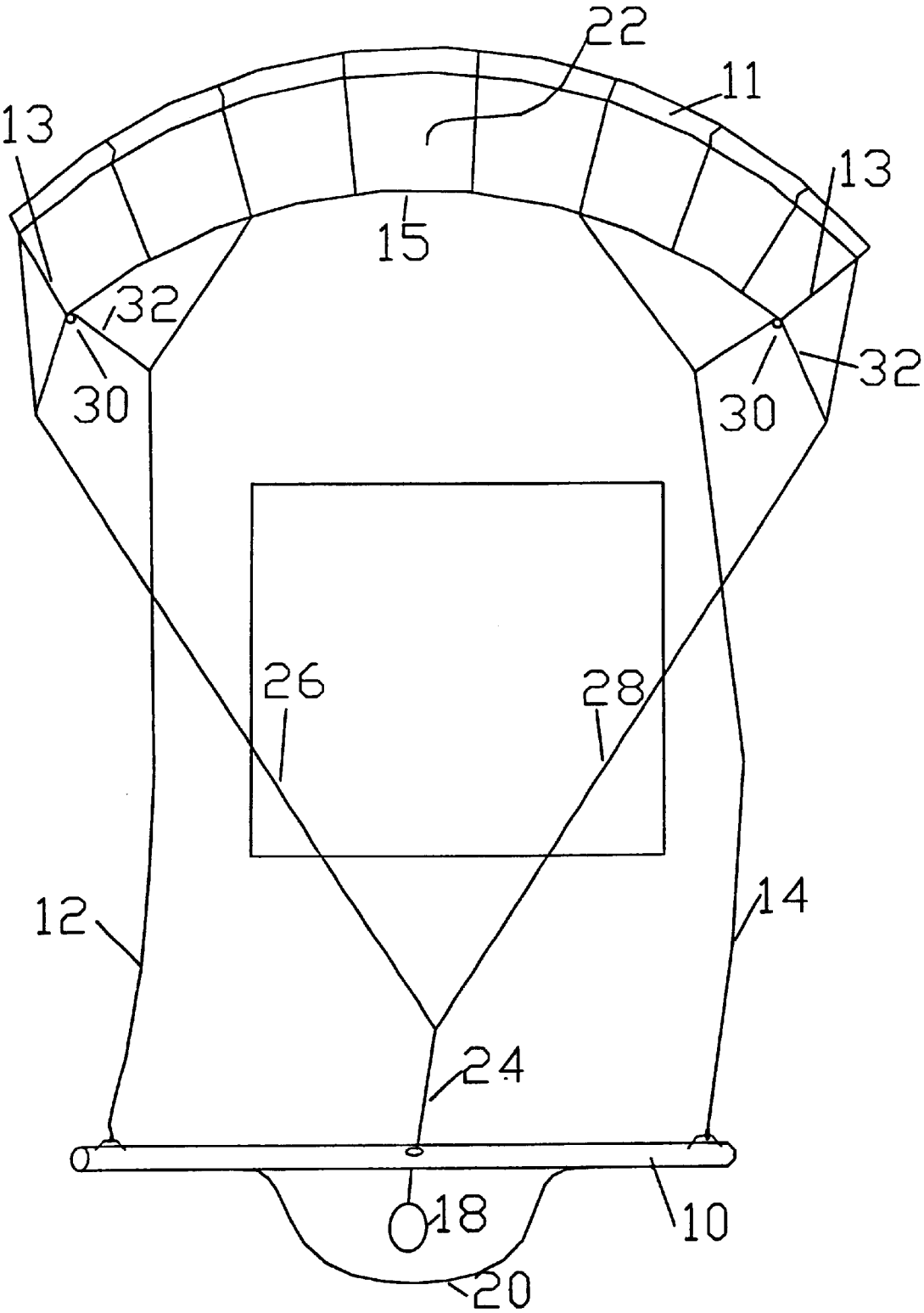
Fig.2 (PRIOR ART)
FIG. 2 shows a known line system.
Figure 3:
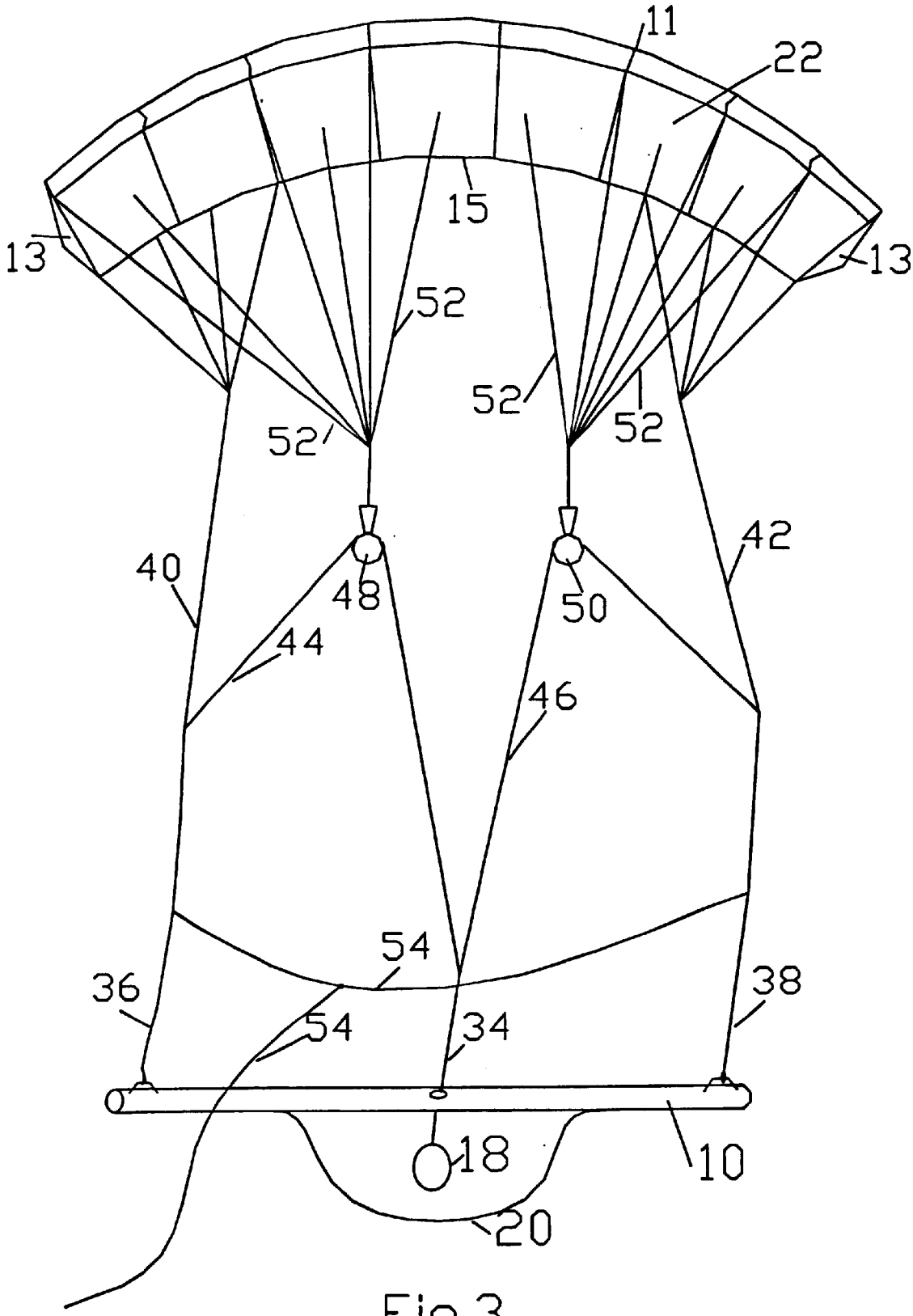
FIG. 3 shows the line system according to the invention.

The function of the line system according to the invention for a soft kite is explained in detail hereinbelow with reference to FIG. 3.

If the left-hand steering line 36 is pulled, then, on the one hand, the trailing profile edge 15 is pulled downward at the left-hand wing end 13 via the left-hand brake line 40. On the other hand, as a result of the connection 44, the kite is also pulled downward as a whole, thus including the profile nose 11, in the left-hand region, albeit, on account of the deflection in the deflecting device 48, only by half the extent of the left-hand brake line 40. Pulling the trailing profile edge 15 downward increases the air resistance on the left-hand side. Half pulling the rest of the kite on the left, including the profile nose 11, downward delays a breakaway of flow. The inflection between the left-hand and right-hand kite halves achieves an additional force component in the curve direction. On the right-hand side, as a result of a release of the brake, as a result of raising the right-hand outer end of the control bar 10, the air resistance is reduced simultaneously. It is thus possible for the kite to be turned very tightly and precisely. A similar result is achieved in the case of pulling the right-hand steering line 38.

This achieves the two elementary functions of steering to the right and left.

If the two steering lines 36, 38 are pulled at the same time, then the kite is curved and is subjected to a steeper angle of attack in the wind. It is then subjected to more pronounced lift in the wind. This thus powers up the kite.

The depowering line 34 and the two steering lines 36, 38 are tensioned during flight since they keep the soft kite in shape via the bridle straps 52. By virtue of all three lines which are connected to the kiteboarder or the control bar 10 (depowering line 34, steering lines 36, 38) being subjected to pulling, it is possible for the-lines to be lengthened to a greater extent than in the case of other line systems, without allowing the flight properties to become spongy and indirect as a result of sagging lines. The kite according to the invention can thus fly at greater heights and come up against stronger winds there, as a result of which the kiteboarder can surf more quickly.

If the depowering line 34 is pulled, this causes the bridle straps 52 to be pulled. The kite is pulled downward as a whole. The brake lines 40, 42, however, remain unchanged, i.e. they are lengthened relative to the rest of the kite 22. The trailing profile edge 15 is thus raised in relation. The kite is relieved of curvature and achieves a shallower angle of attack.

This achieves the elementary depowering function.

If the depowering line 34 is released, the kite is thus in the powered-up state, and the brake lines 40, 42 are shortened in relation. Their length is selected such that, in the powered-up state, they are subjected to pulling and curve the profile.

Relieving the trailing edge of loading may additionally be exploited by the skilled selection of line geometry 52, in order for the angle of attack and/or the action of relieving the kite of curvature to be transferred into the front region of the kite.

In the case of inflatable kites, depowering via the depowering line, which acts on the profile nose at the wing ends, takes place primarily via a change in the angle of attack.

The 3-line system according to the invention allows the brake lines 40, 42 to be kept very short. The brake lines, which sag in the depowered state, thus have less air or water resistance. It is thus possible for the kite to open the trailing edge 15 to a more pronounced extent. The depowering of the kite is thus more effective. This increases the capability of starting up from water when the kite is located in the water with the trailing edge 15 in front. The better release of the brake lines 40, 42 means that it is not so easy for the trailing profile edge 15 to get caught up in the water.

In a further embodiment of the invention, the line system additionally has a safety leash 54 which is fastened by way of its two ends in each case on a steering line, which can also be connected to the kitesurfer and of which the length is selected such that, during normal flying operation, it does not subject the steering lines 37, 38 to any pulling. This, safety leash 54 may be fastened, for example, on the kitesurfer's harness or arm. If the kitesurfer lets go of the control bar 10, then the safety leash 54 secures the two steering lines 36, 38, while the central line 34 is completely released. The flow around the kite breaks away and the trailing edge folds over. The kite folds into the water, or onto the ground, in a pressureless state in rearward flight.

If the two steering lines are subjected to sufficient pulling by virtue of the safety leash 54 being pulled, the kite 22 starts flying rearwards. It is thus possible for the kite, when it is located in the water with the profile nose in front, to be started up again straightforwardly and immediately.

This achieves the elementary functions of rearward flight and start-up from the water.

If, during flight, the two steering lines are pulled to a more pronounced extent than is necessary for rearward flight, the entire trailing profile edge 15 bends over. The flow around the aerofoil profile breaks away cleanly and the kite 22 sinks in a pressureless state, in slow rearward flight, into the water or to the ground.

This thus provides a very effective safety function, that is to say the fifth elementary function.

Figure 4B:
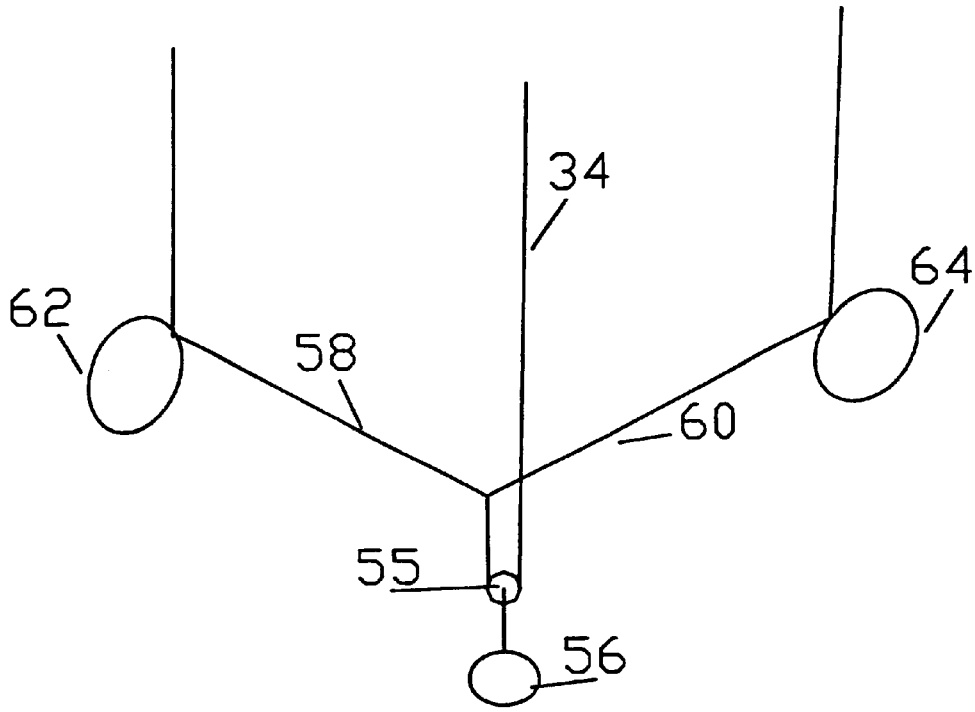
FIG. 4B shows a schematic illustration of the line system at the end directed towards the kiteboarder in the absence of the control bar.
Figure 4A:
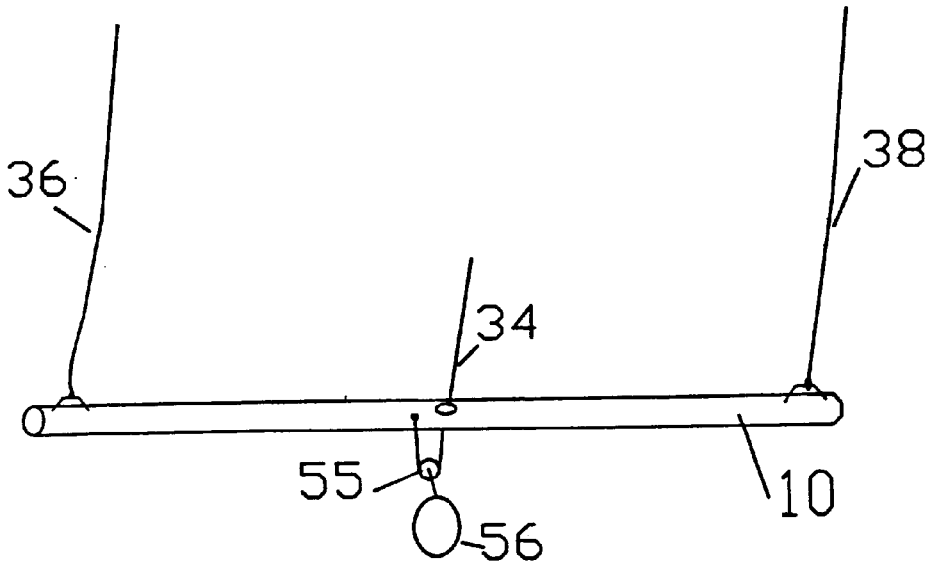
FIG. 4A shows a schematic illustration of a deflecting roller for pressureless depowering.

In a further embodiment of the invention (see FIG. 4A), the depowering line, rather than terminating after being guided into a loop 18 in the control-bar center, is guided back again to the control-bar center by a deflecting roller 55 similar to the rollers 48 and 50. The deflecting roller 55 is connected directly, or via a swivel, to a trim loop 56.

When the kitesurfer fits the harness into this trim loop 56, the pulling force on the control bar 10 corresponds only to the very small pulling force of the brake lines 40, 42. By virtue of the rolling resistances of the rollers, the control bar, once the kitesurfer lets go, remains in the position in which the kitesurfer has let it go. It is only in the case of the brake lines 40, 42 being subjected to relatively high pressure that the undesired effect of the kite being depowered independently can occur. Since the application of force is more or less eliminated in any desired position, the harness line loop 20 is done away with.

The laborious operation of changing over between the harness line loop 20 and the trim loop 18 is dispensed with.

In a further embodiment of the invention (see FIG. 4B), it is possible for the control bar to be omitted and replaced by handles 62, 64 at the end of the steering lines 36, 38. In order to reduce forces, it is possible for the pressureless depowering system to be used for this further embodiment. For this purpose, the depowering line 34 is split, following deflection by way of the trim-loop roller 55, into two lines 58 and 60 and guided to the handles 62, 64 on the steering lines 36 and 38. This further embodiment is particularly suitable wherever a control bar poses problems, e.g. in buggying.

The left-hand and right-hand deflecting devices 48, 50 and the deflecting roller 55 are designed as ball-mounted rollers. As a result, the frictional forces are low and the lines do not display any significant wear. The lines which run by way of the rollers have to be of large dimensions. The rollers should not have too small a radius, in order that the line cannot age too extremely as a result of the inflection. However, the roller should not be too large and unwieldy, in order that the lines do not become tangled as they are relieved of loading. The roller should not jam even in sand. The line material should not twist during use and thus result in the brake line getting caught up with the V line, which could result in depowering not being possible. The line material has to be insensitive to inflection under high load. Before the line core ruptures under loading, this should be detectable, for example, by the casing wearing through, and the kiteboarder should be able to feel this. Dyneema/Spectra is an example of a suitable line material.

In a further embodiment of the invention, the line system has lines which are connected, at one end, to the kite and, at their other end, to the depowering line 34 or to a connecting line 44 between the depowering line 34 and the deflecting devices 48, 50, which thus transmit pulling on the depowering line directly to the kite.

If such lines act on the profile nose 11 at the wing ends 13, extreme depowering may be achieved since the kite then "puts backs it ears", i.e. the wing ends fold over in the forward direction. This results in a drastic reduction in the lift and thus in a rapid descent of the kite at a constant forward speed.

If such lines act in the wing center continuously from the front to the rear, then it is likewise possible to achieve extreme depowering, since in this case the kite folds together in the center. This results in an even more pronounced reduction in the lift.

If such lines act on the entire profile nose 11, then the profile nose may be curved to a pronounced extent. The kite can then start up better from the water.

In a further embodiment of the invention, it is generally possible to vary whether lines are coupled directly to the depowering line 34 and, if so, which ones and how many, and which lines, and how many, are coupled to the depowering line 34 via a deflecting device, that is to say via a block and tackle. It will always be the case here that at least one of the rear planes of the bridle straps 52 will be coupled to the depowering line 34 via a block and tackle, while at least the foremost plane of the bridle straps 52 can be coupled directly to the depowering line 34. In this way, the angle of attack of the kite is effectively reduced by the depowering line. At the same time, however, it is thus also possible to reduce the curvature of the kite via skilled distribution of the movement of the depowering line 34 over the individual planes of the bridle straps 52.

Using only 3 lines, handling is considerably easier as the lines are separated and folded up. The risk of tangling as the lines are wound up and unwound is reduced to a minimum in comparison with four or even five lines. The performance of the kite is noticeably improved since the air resistance of the relatively long flying lines has been reduced.

Large kites can be steered effectively for the first time by the 3-line system according to the invention. The kite turns optimally as a result of the double force on the brake 40, 42 in relation to the bridle strap 52. The additional use of the deflecting roller 55 for pressureless depowering also increases the displacement of the depowering line 34 during movement of the control bar 10 by the arms, which is likewise advantageous for steering large kites in the case of which the lines have to cover relatively large distances in order to achieve a desired change in the shape and position of the kite. The deflecting roller 55 compensates again for the reduction in the displacement of the depowering line 34 by the rollers 48, 50.

List of Designations control bar 10
profile nose 11 left-hand steering line 12
wing ends 13
right-hand steering line 14
trailing profile edge 15
depowering line 16
loop of the depowering line 18
harness line loop 20
kite 22
brake line 24
left-hand brake line 26
right-hand brake line 28
deflecting device 30
connecting line 32
central line 34
left-hand steering line 36
right-hand steering line 38
left-hand brake line 40
right-hand brake line 42
connecting line 44
connecting line 46
deflecting device 48
deflecting device 50
bridle straps 52
safety leash 54
deflecting roller 55
trim loop 56
line 58
line 60
handle 62
handle 64

What is claimed is:

1. A line system for enabling a kitesurfer to steer a kite of the type including, for example, a winglike device formed by an upper sail and a lower sail joined together at a profile nose, a trailing profile edge and wing ends, said line system comprising:

a left-hand steering line and a right-hand steering line;

a depowering line which can be fastened to the kitesurfer, the depowering line dividing into a V-line including a left-hand component and a right-hand component;

a plurality of bridle straps divided up into a left-hand group and a right-hand group and adapted to be fastened to the lower sail and/or to the wing ends of the kite, at least one bridle strap of the left-hand group extending in the direction of the kitesurfer and terminating in a left-hand deflecting device, and at least one bridle strap of the right-hand group extending in the direction of the kitesurfer and terminating in a right-hand deflecting device; and a left-hand brake line and a right-hand brake line adapted to be attached to the trailing profile edge of the kite at least in the region of the wing ends;

wherein the left-hand component is guided over the left-hand deflecting device, and the right-hand component is guided over the right-hand deflecting device;

wherein the left-hand steering line is connected to the left-hand brake line and to the distal end of the left-hand component of the V-line; and wherein the right-hand steering line is connected to the right-hand brake line and to the distal end of the right-hand component of the V-line.

2. A line system as recited in claim 1 and further comprising:

a safety leash connected to said left-hand steering line and to said right-hand steering line, said leash being connectable to the kitesurfer and having a length selected such that, during normal kite flying operation, said leash does not subject the steering lines to any pulling.

3. A line system as recited in claim 1 and further comprising:

a deflecting device which can be connected to the kitesurfer, the depowering line being guided over the deflecting device and coupled to the left-hand steering line and to the right-hand steering line.

4. A line system as recited in claim 3, wherein the deflecting devices are designed as ball-mounted rollers.

5. A line system as recited in claim 1 wherein the deflecting devices are designed as ball-mounted rollers.

6. A line system as recited in claim 1 and further comprising:

lines which are connected, at one end, to the kite and, at their other end, to the depowering line or to a left-hand component or right-hand component between the depowering line and the deflecting devices.

* * * * *